United States Patent [19]

Shepherd

[11] Patent Number: 4,490,311

[45] Date of Patent: Dec. 25, 1984

[54] DRUM HUMIDIFIER

[75] Inventor: Charles G. Shepherd, Oakville, Canada

[73] Assignee: B. D. Wait Co. Limited, Oakville, Canada

[21] Appl. No.: 419,262

[22] Filed: Sep. 17, 1982

[51] Int. Cl.[3] ..... B01F 3/04

[52] U.S. Cl. ..... 261/92; 126/113; 137/426; 137/447; 261/70; 261/DIG. 15

[58] Field of Search ..... 261/70, 92, 64 D, DIG. 15; 137/410, 426, 447; 126/113

[56] References Cited

U.S. PATENT DOCUMENTS

| | | | |
|---|---|---|---|
| 2,858,825 | 11/1958 | Skerritt | 261/DIG. 15 |
| 3,074,698 | 1/1963 | Sevald | 261/DIG. 15 |
| 3,142,310 | 7/1964 | Feldermann | 261/DIG. 15 |
| 3,266,481 | 8/1966 | Wentling et al. | 261/92 X |
| 3,481,588 | 12/1969 | Lobb | 261/92 X |
| 3,659,581 | 5/1972 | Geisler et al. | 261/92 X |
| 3,724,824 | 4/1973 | Mitich | 261/92 |
| 4,056,582 | 11/1977 | Chow | 261/92 X |
| 4,175,296 | 11/1979 | Goldman | 137/426 X |
| 4,192,836 | 3/1980 | Bartscher et al. | 261/64 D X |
| 4,274,365 | 6/1981 | Peters | 137/426 X |

FOREIGN PATENT DOCUMENTS

| | | | |
|---|---|---|---|
| 1092506 | 12/1980 | Canada | 261/DIG. 15 |

*Primary Examiner*—Richard L. Chiesa
*Attorney, Agent, or Firm*—Hirons, Rogers & Scott

[57] ABSTRACT

Improvements to humidifiers are provided. A housing has sides permitting a motor and air duct to be fitted with the motor on one of the sides and the duct on the other to facilitate assembly. The housing is also formed to facilitate removal of a tray containing water. Further features of the invention are a water valve which permits simple adjustment to control various water heights in the tray, and a novel float.

18 Claims, 7 Drawing Figures

DRUM HUMIDIFIER

The present invention relates to humidifiers suitable for adding moisture to the air circulated by a forced air furnace, and more particularly to a water valve and to a housing used in such humidifiers.

It is well known to heat a house using a so-called "forced air system". Such a system heats air within a furnace and circulates it through the rooms of the house by way of a network of ducts. As the air is circulated it gives up moisture on windows and other cold places, and new air inspired from outside has, in general, a lower relative humidity than that in the house when the new air reaches ambient temperatures. It has therefore become a common practice to add moisture to the air circulated by the furnace to increase the humidity within the house.

Moisture is commonly added to the forced air by diverting some of the high pressure hot air delivered by the furnace through an evaporator and into the low pressure return duct of the furnace. The evaporator conventionally comprises a cylindrical frame with its axis horizontal and which is covered by an open-cell pad of foamed synthetic plastic material and a water tray in which the lower part of the pad is immersed. The frame and pad are made to rotate slowly so that as hot air is blown over the surface of the pad, water is evaporated thereby increasing the humidity of the air being returned to the furnace. Such humidifiers are conveniently located adjacent the furnace where the hot and cold air plenums of the furnace are next to one another to facilitate connecting the humidifier to the plenums.

The humidifier usually includes a housing in which the drum rotates and the inlets and outlets are arranged in side and rear walls so that hot air enters the housing, passes about and through the pad, and then exits. To rotate the drum it is necessary to provide a motor which is usually mounted on the opposite side wall. In addition it is necessary to supply water to the tray through an inlet valve which again is mounted on one of the side walls.

Such humidifiers are generally satisfactory but they do present problems of installation both because of the location of the humidifier in places which may have limited space for the installer to work and also because the existing arrangement of ducts and plenums does not lend itself to the positioning and attachment of the humidifier. These problems have been overcome to some extent in the past by making similar openings in each side wall of the humidifier and then providing fittings with screws or bolts to permit the necessary duct and motor to be fitted to either one of the walls as needed. Such an arrangement requires great dexterity on the part of the installer and has come to be recognised as a major difficulty in the art. One other approach to solving the problem has been to make the housing of the humidifier such that it can be assembled "upside-down" in relation to its normal position. This however makes for design restrictions and more complexity in manufacture. Accordingly in one of its aspects the present invention provides a housing for a humidifier which permits simple assembly with the duct and motor arranged in either of the walls as required.

A further disadvantage of earlier humidifiers is the difficulty encountered in negotiating the water tray past the water valve when removing and reinstalling the tray during maintenance procedures. Accordingly, in a second of its aspects, the invention provides a humidifier housing which permits simple entry and removal of the water tray without requiring movement or adjustment of the water valve.

Yet another disadvantage of such humidifiers is that the water valve tends to be a relatively expensive item which also suffers from the effects of the environment. The associated float is either a sealed foamed plastic element or a glass capsule. Both are very difficult to clean. Further the associated water valve is normally attached to the float using an adjustable linkage which requires delicate adjustment to set the water level to the required height in the water tray. This is often difficult to do in the cramped environment normally containing the humidifier. Still another aspect of the invention is to provide a simplified valve assembly providing controlled and repeatable adjustment of the float height as well as an improved float which can be cleaned efficiently.

These and other aspects of the invention will become apparent from the following description of embodiments of the invention when taken in combination with the drawings in which.

Figure 1:
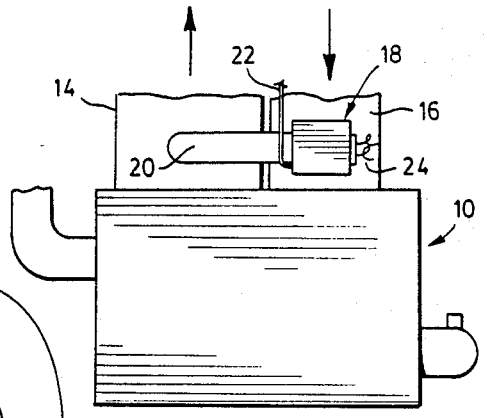
FIG. 1 is a diagrammatic representation of a forced air furnace installation and shows a humidifier assembly in position on the furnace.

Referring first to FIG. 1, a forced air furnace 10 delivers hot air to a hot air plenum 14 which delivers the air to a network of ducts for distribution about the interior of a house. Air is returned from the rooms of the house to a cold air return plenum 16 leading to a heat exchanger within the furnace for heating the air before it again leaves via the hot air plenum 14. A humidifier 18 is mounted on the cold air plenum 16 to receive hot air under pressure via a duct 20 attached to the hot air plenum 14. The resulting humidified air is then returned to the plenum 16. Water is supplied to the humidifier by a water pipe 22 and electrical power is supplied through wires 24. (This is the preferred arrangement although it is recognised in the art that acceptable results can be achieved by mounting this type of humidifier on the hot air plenum 16 and thereby reversing the flow.)

Figure 2:
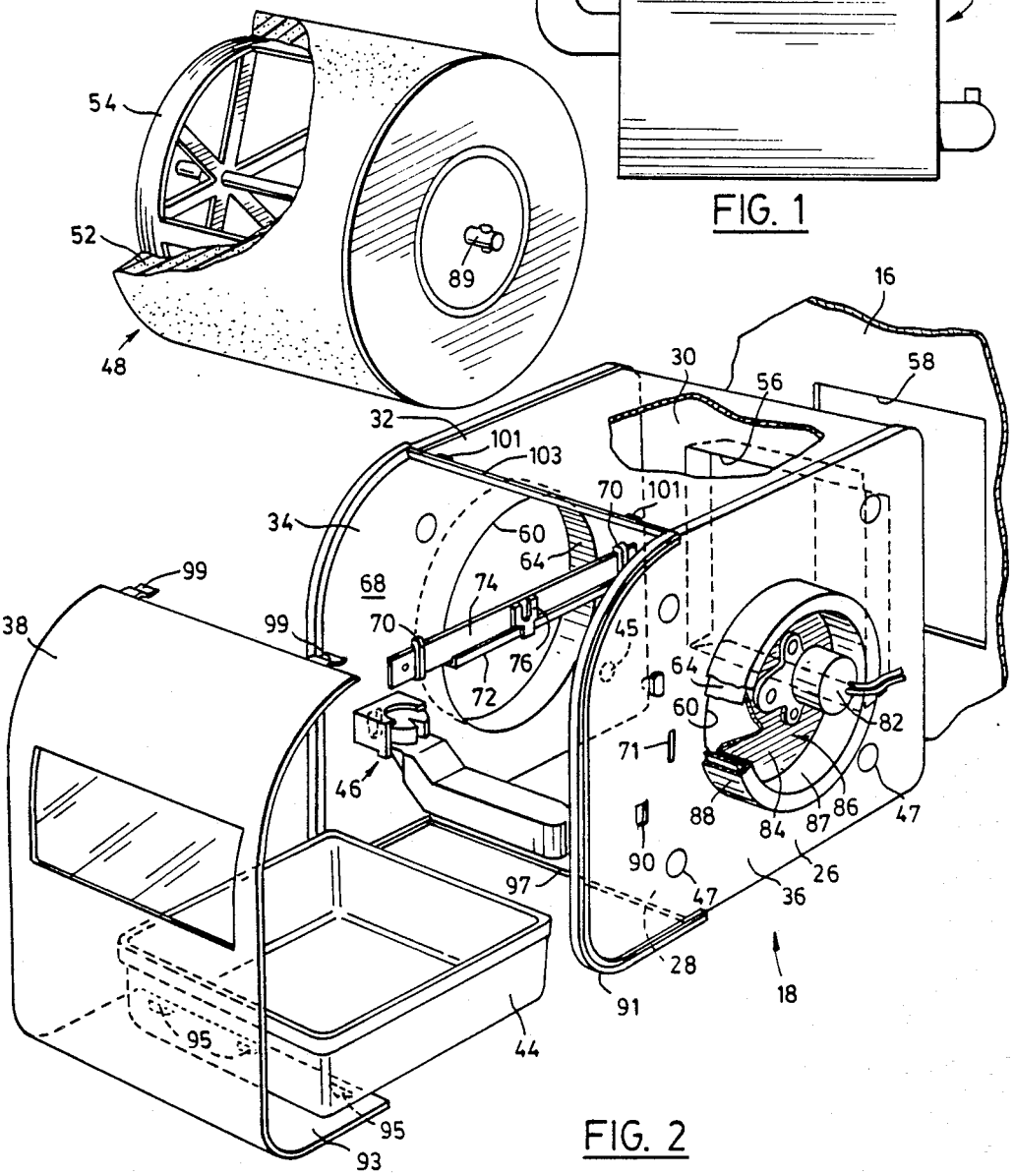
FIG. 2 is an exploded view of a preferred embodiment of a humidifier used in the assembly shown in FIG. 1.

Referring now to FIG. 2, the humidifier 18 includes a housing 26 formed by a base 28, a rear wall 30, a top 32 and a pair of side walls 34, 36. A door 38 is provided to close the open front of the housing and is attached as will be described.

A water tray 44 is adapted to be supported on the base 28 and centred relative to the side walls 34, 36 by dimples 45, 47 formed inwardly of the side walls. The tray receives water from the water pipe 22 through a float valve 46 which controls the level of water in the tray 44 so that an adequate supply is always available for humidifying air passing through the housing 26.

A humidifier drum 48 is rotatably supported within the housing 26 at opposite ends of its axle 50 and includes a conventional annular pad 52 of foamed synthetic plastic material supported by an open cylindrical framework 54. The drum 48 is supported so that as it rotates the pad 52 passes through water in the tray 44. Air passing through the housing 26 meets a wet pad and evaporates the water to thereby increase the moisture content of this air.

An opening 56 formed in the rear wall 30 receives air. This opening mates with a corresponding opening 58 formed in the wall of the plenum 16 to which the humidifier is attached. The side walls 34, 36 are each formed with similar circular apertures 60, only one of which can be seen in this view. The apertures are aligned with one another and are made to be concentric with the axis about which the drum 48 rotates. Flanges 64 extend around the respective peripheries of each of the apertures 60 to provide upstanding cylindrical walls extending outwardly from the exterior surfaces of the side walls 34, 36.

Figure 3:
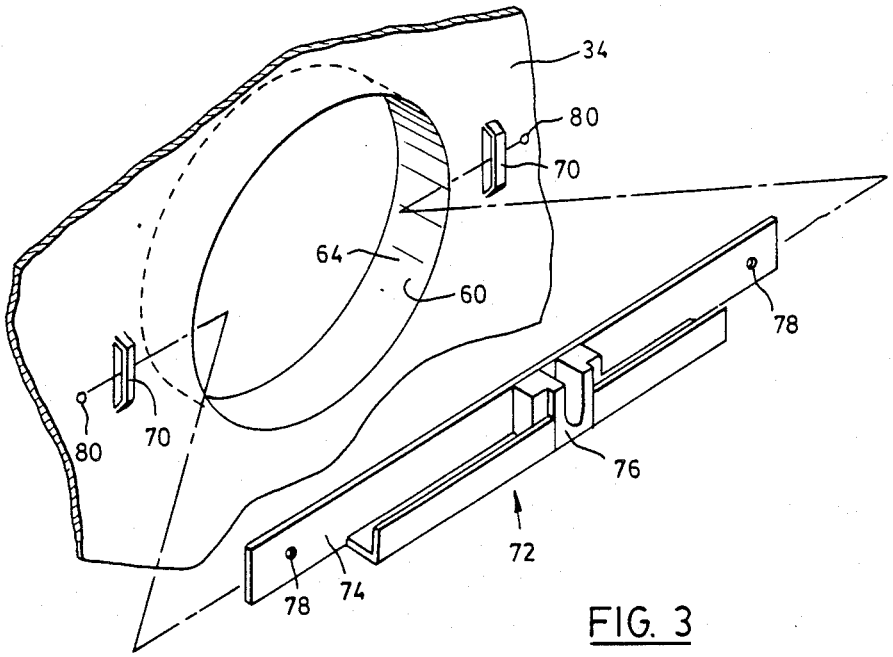
FIG. 3 is an enlarged perspective view of a portion of one of the side walls of the humidifier shown in FIG. 2 and of a bracket to be attached to the side wall.

Reference is next made to FIGS. 2 and 3. Each of the interior surfaces 68 of the side walls 34, 36 is provided with a pair of straps 70 lanced from the walls to form inwardly disposed loops (as can be seen on side wall 34) and leaving openings 71 in the walls, some of which can be seen in FIGS. 2 and 3). The straps 70 are arranged to support a bracket 72 on one of the side walls 34 or 36 as will be described. The bracket 72 is shown in relation to side wall 34 in FIGS. 2 and 3 and includes a strip 74, the ends of which are adapted to pass through respective straps 70, and a bearing member 76 is located midway along the strip 74 located partly by the strip 74 and a pair of L-shaped elements 77 attached to the strip. The bearing member 76 is of sintered bronze and is located in the assembly by moving it downwardly into the position shown in FIG. 3.

The bracket 72 also defines a pair of small openings 78 adjacent its ends and spaced apart to match the spacing between a pair of small dimples 80 formed inwardly of the wall 34. There is sufficient resiliency in the structure that it is possible to engage an inner end of the strip 74 in the corresponding strap 70, and to move it inwardly until the outward end of the strip has passed beyond the outer one of the straps 70. The strip can then be moved in the opposite direction to engage the outer end behind a corresponding strap 70 and the movement is continued until the openings 78 are in engagement over the dimples 80 to locate the bracket during use. The bracket is then in position over the apertures 60 in the wall 34 and the bearing member 76 is disposed centrally for carrying the drum 48 as will be described.

A motor 82 is provided to rotate the drum 48 and is mounted on a face 84 of a re-entrant end cap 86, which is defined by the face 84, and cylindrical inner and outer walls 87, 88. The diameter of the outer wall 88 is chosen to fit snugly over the flange 64 of wall 36 to seal the corresponding aperture 60. The motor 82 includes a conventional drive coupling (not shown) that engages the end 89 (FIG. 2) of the axle to support and rotate it.

The end cap 86 may be positioned on either of the flanges 64 of the side walls 34, 36 and the bracket 72 may likewise be positioned on the side wall opposite the end cap. The flange 64 adjacent the bracket 72 is proportioned to receive a standard size of ducting to form the by-pass duct 20. It will therefore be apparent that the by-pass duct 20 can be connected to either of the side walls and the end cap fitted to the opposite side wall to facilitate installation of the humidifier 18 on the furnace 10. This assembly is done very simply and requires minimal dexterity on the part of the installer. Also, the float valve 46 is likewise mounted interchangeably by providing holes 90 (one of which can be seen in the wall 36) in both of the side walls 34, 36. The exposed opening 90 is closed by a plug of a suitable synthetic plastic material, tape or other means if desired.

As seen in FIG. 2, the base 28 is cut back behind the forward extremities of the side walls 34, 36 and, when viewed from above, is behind the float valve 46. This simple structure provides a significant advantage in use. When the user needs to remove the drum 48 and water tray 44 for maintenance, the drum can be lifted forwardly and upwardly facilitated by the recessed top 32. However, the practice in removing the tray has been to adjust the setting of the float valve 46 upwardly, and then, while holding the float up with one hand, to pull the tray 44 out forwardly with the other hand. The float valve has maintained a water level in the tray, and because the user is often working in cramped surroundings, it is very common for the water to be spilled. This undesirable result can be avoided with the present structure. The user simply pulls the tray until it reaches the forward end of base 28, then, before it meets the valve 46, the tray is lowered away from the housing using both hands for support. Consequently unlike prior art structures, the removal of the tray does not affect the setting of the valve. Previously after returning the tray, the valve height had to be re-set.

The door 38 is shaped to close the front of the housing by engagement with an edge seal 91 extending about the front opening of the housing. The door has a bottom portion 93 defining three outwardly extending barbs 95 having ends adapted to engage a small roll 97 formed in the forward extremity of the base 28, and a pair of shaped tongues 99 at its upper extremity for engagement in openings 101 in the top of the housing and behind another roll 103 formed at the front extremity of the top 32. The door is assembled by first engaging the tongues 99 in the openings 101 and then, while applying a slight downward force on the door, the barbs 95 are snapped behind the roll 97 in the base 28.

Figure 4:
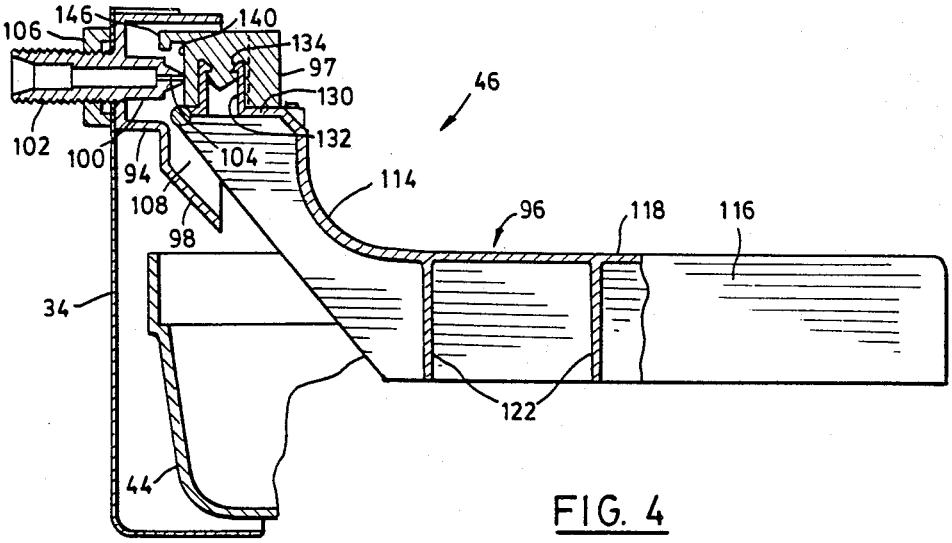
FIG. 4 is a part sectional sideview of a float valve used in the humidifier.
Figure 5:
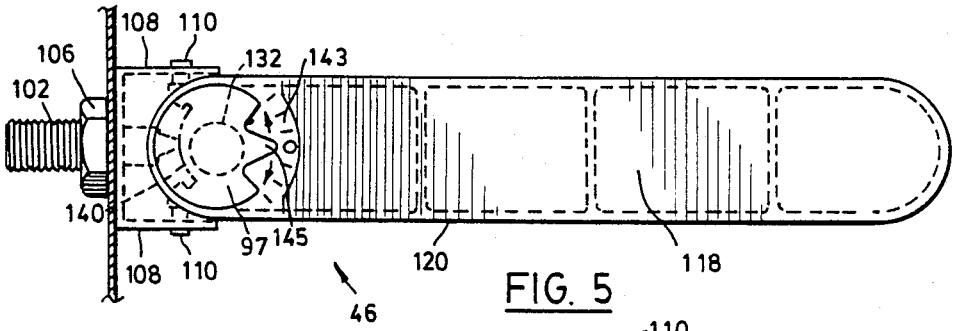
FIG. 5 is a plan view of the float valve shown in FIG. 4.
Figure 6:
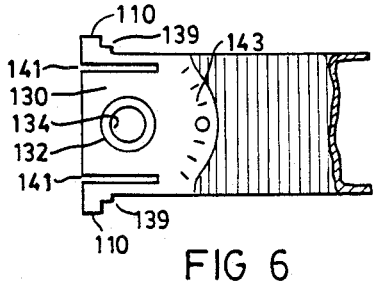
FIG. 6 is a partial top view of a float used in the float valve.

Reference is next made to FIGS. 4, 5 and 6 to describe the float valve 46 which includes a valve body 94, a float 96 pivotally connected to the body, and a sealing member 97 attached to the float 96. The body 94 is molded to include a shroud 98 surrounding a nozzle 100 which has an orifice 104 communicating with the water inlet pipe 22 through a cylindrical extension 102. This extension is threaded conventionally to receive a fitting on the end of the water pipe 22 and a nut 106 which clamps the wall 34 between the shroud portion of the body and the nut.

The float 96 is pivotally connected to side walls 108 of the shroud 98 by means of a pair of cylindrical stubs 110 extending into holes in the side walls 108. The float 96 is a one piece molding which includes a downwardly sloping arm 114 and a float member 116 having a top 118 and a downwardly-extending skirt 120 extending around the periphery of the top 118. A plurality of partitions 122 extend downwardly from the top 118 and between the opposed inner faces of the skirt 120. The partition, skirt and top therefore define a number of cells to trap air when the float is immersed in water. The arm 114 terminates at a platform 130 having an upright cylindrical spigot 132 which includes an inwardly directed shoulder 134 at its upper end. The sealing member 97 has an opening in its underside proportioned to be a snug fit on the spigot 132 and includes a tang 138 which engages below the shoulder 134 to retain the member 97 in place. The member is preferably of rubber but can be of any suitable synthetic plastic material having similar characteristics.

The platform 130 is better seen in FIG. 6. The aligned stubs 110 have small shoulders 139 to separate the main part of the float from the shroud to limit the effects of friction between these parts. To enable the stubs to be positioned in the shroud, the platform 130 is relieved by a pair of slits 141 which permit the stubs to be deflected inwardly during engagement. There will of course be some resilience in the shroud itself but the slits are desirable to facilitate engagement of the stubs in the shroud.

The platform 130 is also shaped to include a scale 142 formed in an arc with its centre at the centre of the spigot 134. This scale can also be seen in FIG. 5 in association with an indicator 145 formed in the sealing member 97 to demonstrate the angular position of this member relative to the axis of the spigot 132.

As seen in FIGS. 4 and 5, the sealing member 97 includes a peripheral recess opposite the indicator 145 and containing the nozzle 104 which is in an engagement with an upright wall defining the inner extremity of the recess. This wall is not concentric with the axis of the spigot 132. It is cylindrical with its axis offset so that as drawn in FIG. 5, the wall is nearer the axis of the spigot 132 at the bottom of the sealing member than it is at the top. Consequently, when the member 97 is rotated in a clockwise direction from the position drawn in FIG. 5, the result will be that the float 96 is free to hold upwardly beyond the point shown in FIG. 4 before it seals against the nozzle 104. Conversely, if the member is rotated in an anti-clockwise direction, when the float will be forced to move downwardly relative to its position in FIG. 4. Consequently, no matter what the local water pressure may be, by rotating this member the user can select the setting required to maintain the recommended level of water in the tray 44. For convenience, the position of the member 97 is demonstrated by the position of the projection 145 relative to the scale 143.

The recess 140 in the sealing member 97 combines with the walls of the shroud 98 to contain spray emitted when water issues from the orifice 104 and impinges on the wall 140. The water collects in the shroud and flows down the lower part of the shroud into the tray 44. To this end, the top of the recess has an overhanging wall 146 terminating in a downward lip to help to contain the spray.

The float valve 46 is assembled by attaching the float to the shroud as already described. Next the cylindrical extension 102 of the body 94 is engaged through the opening in the wall 34 and the nut 106 threaded onto this projection. Although not seen in FIG. 4, the cylindrical projection terminates adjacent to the shroud to take a form which fits in an elongated opening such as the opening 90 so that the shroud is upright and locked in position when the nut is applied. Once the tray has been positioned in the housing and the water connected to the valve 46, the tray will fill because the float 96 will fall under gravity away from the nozzle 104. As the tray fills, air will be trapped in the cells of the float and its buoyancy will bring the float back into the position shown in FIG. 4 where the sealing member 97 will engage the nozzle and prevent further flow. As the water is used for the tray, then more water will enter through the nozzle periodically. Should the user decide that too much of the pad 52 (FIG. 2) is immersed in the tray, then by rotating the sealing member 97 anti-clockwise as drawn in FIG. 5, the valve 46 will then retain a lower level of water in the tray. Similarly, a higher level can be maintained if the sealing member 97 is moved in a clockwise direction relative to FIG. 5.

Should it be found that for some reason the member 97 does not seal the water flow, then it can be replaced by simply pulling it upwardly out of engagement with the float 96 and by replacing it with a new sealing member. Similarly, if for some reason the float should require replacement, then this can be done by dislodging it from the shroud and replacing it with a new float. Of course if the nozzle 104 should prove to be faulty, then it will be necessary to remove the entire assembly and replace the nozzle. It should also be noted that any build up of calcium on the float can be removed simply by flexing its walls. The brittle nature of the calcium will cause it to break and fall off.

When assembling the humidifier prior to attachment to a furnace, the installer decides which wall is to carry the motor and the float valve. Accordingly the float valve is assembled in one of the holes 90 in the side walls and the end cap 86 is attached to one of the flanges 64 as required. Normally the motor 82 will be pre-assembled on the end cap 86 so that the motor is now also in place. Next the bracket 72 is installed on the wall opposite the motor as previously explained.

The partial assembly is then attached to the selected plenum, e.g. the cold air plenum 16, about opening 58 using conventional sheet metal screws or the like and the duct 20 engaged on the other of the side-wall flanges 64 and coupled to the hot air plenum 14. The tray 44 and drum 48 are entered and water and electricity hooked up. The humidifier is then operational and is closed using the door 38.

Should it be necessary to reinstall the humidifier in another location it can be disassembled but it will more usually remain in place without being moved.

Figure 7:
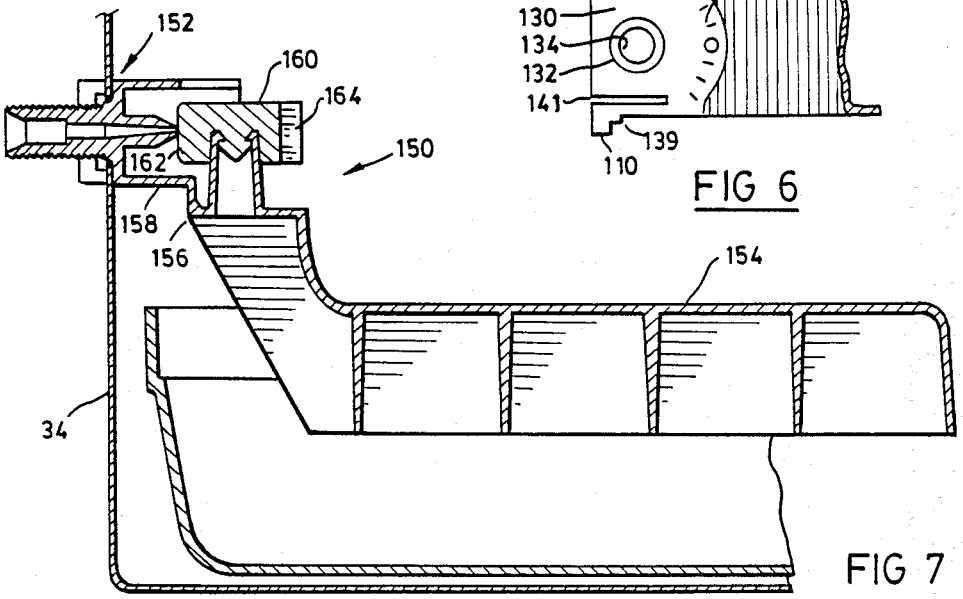
FIG. 7 is a view similar to FIG. 4 showing an alternative embodiment of the float valve.

Reference is next made to FIG. 7 which illustrates an alternative embodiment of the float valve. In this embodiment, a float valve 150 is provided having a body 152 integrally molded with a float 154 and connected to the float by a so-called "living hinge" 156. A shroud 158 differs from that previously described in that it contains a simplified form of sealing member 160 which has a face 162 shaped to give the necessary variation corresponding to the wall 140 shown in FIG. 4. The member 160 includes an indicator 164 for a general indication relative to the float but it is not associated with a specific scale. Here again, the member can be removed for replacement but in this instance, the float is an integral part of the assembly and cannot be removed without disconnecting the whole assembly from the wall 34. However, this construction may have some advantages over the embodiment previously described.

It will be appreciated that a humidifier has been described with reference to specific aspects of its construction which simplifies both the installation and maintenance of the humidifier. Further, the structure offers advantages in manufacture, particularly the float valve embodiments which are simplified significantly with reference to prior art structures. However, it will be appreciated that other embodiments can be designed within the scope of the invention as claimed.

I claim:

1. A float valve assembly comprising: an inlet nozzle, a float mounted for pivotal movement vertically relative to said nozzle; and a sealing member carried by said float for movement therewith, said sealing member being rotatably mounted on said float and having a sealing surface engageable with said nozzle to control the flow of fluid therethrough, the sealing surface being eccentric to the axis of rotation of the sealing member whereby rotation of the sealing member relative to the float varies the relative angular disposition of the float and the nozzle and the float can be used to maintain water in a tray to depths selected from a range of depths dependant on the length of the sealing surface.

2. A float valve assembly according to claim 1 wherein the sealing member further includes a lip projecting beyond said sealing surface and above said nozzle to deflect downwardly fluid issuing from the nozzle.

3. A float valve assembly according to claim 2 wherein said float further includes a downwardly inclined arm, the sealing member being rotatably supported at the upper extremities of the arm adjacent and above the pivotal connection to the body.

4. A float valve according to claim 3 wherein the sealing member is rotatably supported on a spigot upstanding from said arm.

5. A float valve assembly according to claim 3 wherein the float includes an elongated top, at the lower end of the arm, a skirt dependent downwardly from the top along its sides, and at least one partition extending between spaced locations on the skirt to define at least one air cell on the underside of the float.

6. A humidifier comprising:

a housing to enclose a drum for rotation about a horizontal axis, the housing having a pair of side walls defining apertures aligned about a horizontal axis and defining outwardly extending flanges around the periphery of the apertures and a base; a bracket detachably mounted on one of said side walls, an end cap supported on the other of said side walls by engagement with the respective one of said flanges to seal the aperture in the other of said side walls and provide support for the motor, the end cap and the bracket being interchangeable between the side walls to facilitate attachment of ducting to either of the flanges on the side wall as required in installation; a float valve assembly attached to one of the side walls and having an inlet nozzle, a float mounted for pivotal movement vertically relative to said nozzle, and a sealing member carried by said float for movement therewith, said sealing member being rotatably mounted on said float and having a sealing surface engageable with said nozzle to control the flow of fluid therethrough, the sealing surface being eccentric to the axis of rotation of the sealing member whereby rotation of the sealing member relative to the float varies the relative angular disposition of the float and the nozzle; and a tray resting on said base for receiving water from the float valve in response to a change of water level in the tray, the water level being selected from a range dependant on the angular positions of the sealing surface relative to the float.

7. A humidifier according to claim 6 wherein the end cap includes a skirt extending around the periphery of the cap, the skirt overlying the flange to mount the cap on the side wall.

8. A humidifier according to claim 6 wherein each side wall includes a second aperture located between the front and the first mentioned apertures, the float valve being mounted in one of said second apertures.

9. A humidifier as claimed in claim 6 in which the base is recessed inwardly of the forward extremities of the side walls and of the second apertures to provide for entry and removal of the water tray.

10. A humidifier as claimed in claim 6 wherein the sealing member further includes a lip projecting beyond said sealing surface and above said nozzle to deflect downwardly fluid issuing from the nozzle.

11. A humidifier according to claim 10 wherein said float further includes a downwardly inclined arm, the sealing member being rotatably supported at the upper extremities of the arm adjacent and above the pivotal connection to the body.

12. A humidifier according to claim 11 wherein the sealing member is rotatably supported on a spigot upstanding from said arm.

13. A humidifier according to claim 11 wherein the float includes an elongated top, at the lower end of the arm, a skirt dependent downwardly from the top along its sides, and at least one partition extending between spaced locations on the skirt to define at least one air cell on the underside of the float.

14. A humidifier comprising:

a housing having a top, a base, an open front, a rear wall defining an opening for passage of air through the housing, and a pair of parallel side walls defining a pair of similar circular apertures located in the regions of the side walls intersected by an axis of rotation lying perpendicular to the side walls, the side walls including similar outwardly extending cylindrical flanges surrounding the apertures and attachment means on both side walls;

a door adapted to close the front;

a cap mounted on one of the flanges on the side walls to cover the corresponding aperture formed in the side wall;

a bracket having a bearing member, the bracket being mounted detachably in a horizontal orientation on one of said side walls by said attachment means, and having an upwardly opening U-shaped bearing on said horizontal axis;

motor means attached to said cap;

a drum having a water absorbant outer layer and a central axle lying about said horizontal axis and having ends extending beyond the outer layer, one of the ends being supported by and drivably coupled to the motor and the other of said ends resting in said bearing to support the drum for rotation by the motor about the horizontal axis so that in use air can be forced to move between the opening in the rear wall and the aperture in the side wall selected to carry the bracket;

a water reservoir resting on the base to carry water to a level where part of the water absorbent outer layer of the drum is immersed in the water; and a float valve attached to one of the side walls to control the level of water in the reservoir.

15. A humidifier according to claim 14 wherein the bracket attachment means is pairs of loops positioned one loop to each side of the apertures and in which the bracket includes a strip engageable in the loops.

16. A humidifier according to claim 15 wherein said cap includes a skirt extending around the periphery of the cap, the skirt overlying the flange to mount the cap on the side wall.

17. A humidifier according to claim 14 wherein each side wall includes a second aperture located between the front and the first mentioned apertures for receiving a float valve.

18. A humidifier as claimed in claim 14 in which the base is recessed inwardly of the forward extremities of the side walls and of the second apertures to provide for entry and removal of the water reservoir which in use rests on the base with the float of the float valve inside the tray.

* * * * *